US009244378B2

(12) United States Patent
Imai et al.

(10) Patent No.: US 9,244,378 B2
(45) Date of Patent: Jan. 26, 2016

(54) DEVELOPING ROLLER AND DEVELOPING DEVICE PROVIDED WITH THE SAME

(71) Applicants: Masashi Imai, Kasugai (JP); Marika Ogiso, Nagoya (JP)

(72) Inventors: Masashi Imai, Kasugai (JP); Marika Ogiso, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/224,221

(22) Filed: Mar. 25, 2014

(65) Prior Publication Data

US 2014/0294433 A1 Oct. 2, 2014

(30) Foreign Application Priority Data

Mar. 28, 2013 (JP) ..... 2013-069204

(51) Int. Cl.
*G03G 15/08* (2006.01)

(52) U.S. Cl.
CPC ..... *G03G 15/0818* (2013.01); *G03G 15/0896* (2013.01); *G03G 2215/0861* (2013.01)

(58) Field of Classification Search
CPC ..... G03G 15/0818; G03G 15/0896; G03G 2215/0861
USPC ..... 399/279, 286
See application file for complete search history.

(56) References Cited

U.S. PATENT DOCUMENTS

| | | | | |
|---|---|---|---|---|
| 4,506,972 | A * | 3/1985 | Murakami et al. | 399/103 |
| 2005/0185981 | A1 * | 8/2005 | Ohshika | 399/103 |
| 2012/0051800 | A1 | 3/2012 | Yamazaki et al. | |

FOREIGN PATENT DOCUMENTS

| | | | |
|---|---|---|---|
| JP | 7-187438 | A | 7/1995 |
| JP | 7-230216 | A | 8/1995 |
| JP | 2001-160507 | A | 6/2001 |
| JP | 2012-53109 | A | 3/2012 |

* cited by examiner

*Primary Examiner* — Benjamin Schmitt
(74) *Attorney, Agent, or Firm* — Merchant & Gould PC

(57) ABSTRACT

A developing roller configured to carry developer and extending in an axial direction includes: a first rotation shaft; a second rotation shaft; a rubber body portion; a first cylindrical rubber portion; and a second cylindrical rubber portion. The body portion has a first side and a second side opposite to the first side in the axial direction. The first cylindrical rubber portion is disposed on the first side. The first rotation shaft is configured to be fitted with the first cylindrical rubber portion. The second cylindrical rubber portion is disposed on the second side. The second rotation shaft is configured to be fitted with the second cylindrical rubber portion. The rubber body portion is configured to be deformable more than the first cylindrical rubber portion and the second cylindrical rubber portion.

10 Claims, 5 Drawing Sheets

DEVELOPING ROLLER AND DEVELOPING DEVICE PROVIDED WITH THE SAME

CROSS REFERENCE TO RELATED APPLICATION

This application claims priority from Japanese Patent Application No. 2013-069204 filed Mar. 28, 2013. The entire content of the priority application is incorporated herein by reference.

TECHNICAL FIELD

The present invention relates to a developing roller for carrying a developer, and a developing device provided with the developing roller.

BACKGROUND

There is conventionally known a developing device including a developing roller and a supply roller for supplying a developer to the developing roller. More specifically, the developing roller includes a rotation shaft made of metal and a hollow cylindrical rubber portion for covering an outer peripheral surface of the rotation shaft. The rubber portion has a uniform wall thickness along an axial direction of the rotation shaft.

SUMMARY

However, with the above-described conventional structure, the cylindrical rubber portion is supported by the metal rotation shaft, which hardens the rubber portion. This may results in excessive application of stress to the developer located at a nip portion between the developing roller and the supply roller.

In view of the foregoing, it is an object of the present invention to provide a developing roller capable of restraining excessive application of stress to a developer located at a nip portion between the developing roller and a supply roller, and a developing device provided with the developing roller.

In order to attain the above and other objects, the present invention provides a developing roller configured to carry developer and extending in an axial direction including: a first rotation shaft; a second rotation shaft; a rubber body portion; a first cylindrical rubber portion; and a second cylindrical rubber portion. The rubber body portion has a first side and a second side opposite to the first side in the axial direction. The first cylindrical rubber portion is disposed on the first side. The first rotation shaft is configured to be fitted with the first cylindrical rubber portion. The second cylindrical rubber portion is disposed on the second side. The second rotation shaft is configured to be fitted with the second cylindrical rubber portion. The rubber body portion is configured to be deformable more than the first cylindrical rubber portion and the second cylindrical rubber portion.

According to another aspect, the present invention provides a developing device including a developing roller configured to carry developer and extending in an axial direction. The developing roller includes: a first rotation shaft; a second rotation shaft; a rubber body portion; a first cylindrical rubber portion; and a second cylindrical rubber portion. The rubber body portion has a first side and a second side opposite to the first side in the axial direction. The first cylindrical rubber portion is disposed on the first side. The first rotation shaft is configured to be fitted with the first cylindrical rubber portion. The second cylindrical rubber portion is disposed on the second side. The second rotation shaft is configured to be fitted with the second cylindrical rubber portion. The rubber body portion is configured to be deformable more than the first cylindrical rubber portion and the second cylindrical rubber portion.

DETAILED DESCRIPTION

Figure 1:
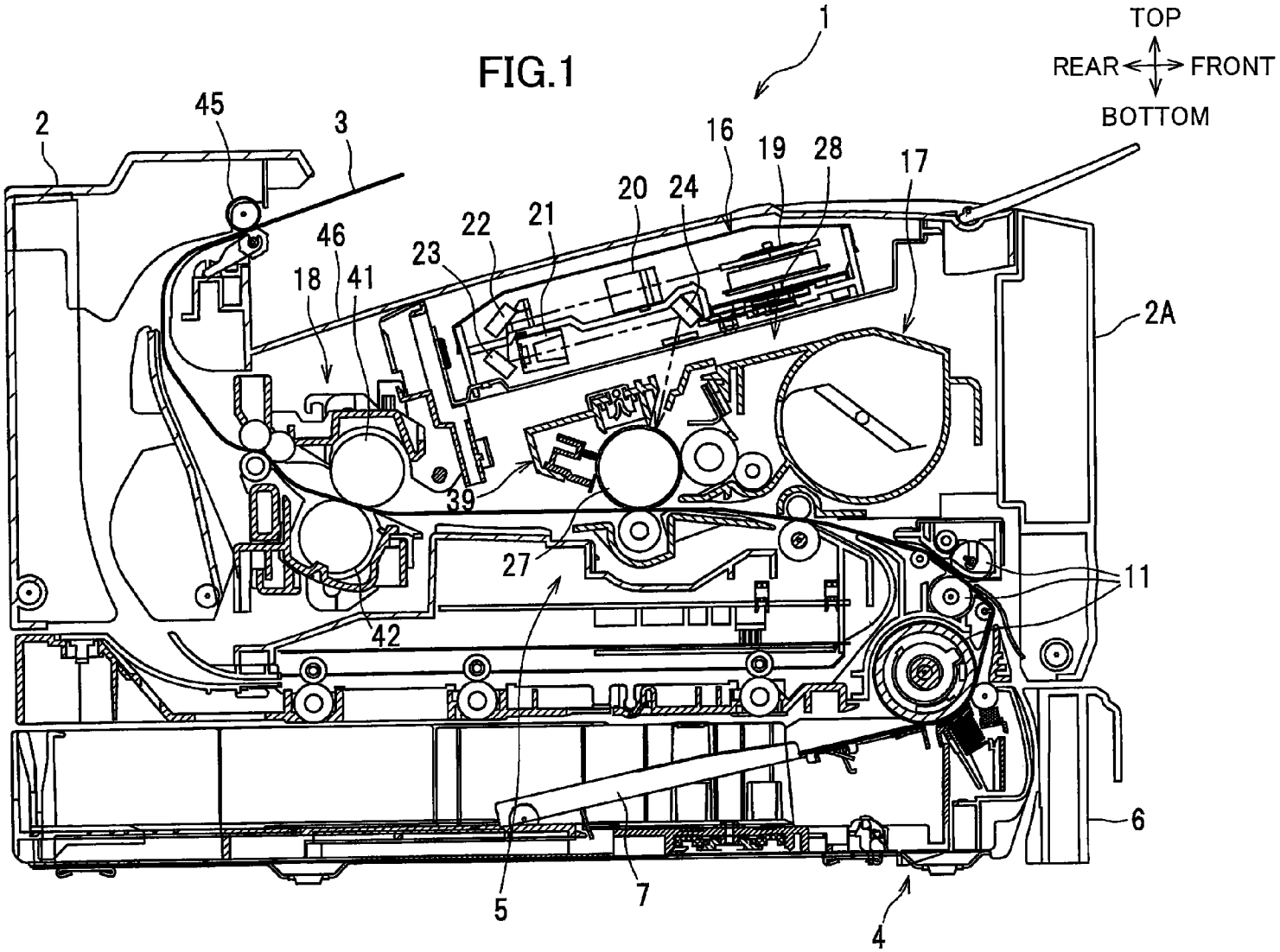
FIG. 1 is a cross-sectional view of a laser printer provided with a developing cartridge according to one embodiment of the present invention.

A laser printer provided with a developing cartridge according to one embodiment of the present invention will be described with reference to FIGS. 1 through 4B, wherein like parts and components are designated by the same reference numerals to avoid duplicating description.

In the following description, the terms "upward", "downward", "upper", "lower", "above", "below", "beneath", "right", "left", "front", "rear" and the like will be used assuming that the laser printer 1 is disposed in an orientation in which it is intended to be used. More specifically, in FIG. 1, a left side and a right side are a rear side and a front side, respectively. Further, in FIG. 1, a top side and a bottom side are a top side and a bottom side, respectively.

Overall Structure of Laser Printer

As illustrated in FIG. 1, the laser printer 1 includes a main casing 2, and within the main casing 2, a feeder section 4 for feeding a sheet 3 and an image forming section 5 for forming an image on the sheet 3 are provided.

The feeder section 4 includes a sheet supply tray 6 detachably mounted in a bottom portion of the main casing 2, and a sheet pressing plate 7 provided in the sheet supply tray 6. The feeder section 4 further includes various rollers 11 for feeding the sheet 3 and removing paper dust from the sheet 3. In the feeder section 4, the paper pressing plate 7 presses the plurality of sheets 3 accommodated in the sheet supply tray 6 upward, and the various rollers 11 feed the plurality of sheets 3 one at a time to the image forming section 5.

The image forming section 5 includes a scanner unit 16, a process cartridge 17, and a fixing unit 18.

The scanner unit 16 is provided in an upper portion of the main casing 2 and includes a laser emitting unit (not illustrated), a rotationally-driven polygon mirror 19, lenses 20 and 21, and reflecting mirrors 22, 23 and 24. In the scanner unit 16, a laser beam passes through a path denoted by a dashed double-dotted line in FIG. 1 to be irradiated in a high-speed scan onto a surface of a photosensitive drum 27.

The process cartridge 17 is detachably mounted in the main casing 2 through an opening formed in a front wall of the main casing 2, by opening a front cover 2*a* provided at the front wall of the main casing 2 for covering the opening. The process cartridge 17 includes a developing cartridge 28 (as an example of a developing device) and a drum unit 39.

Figure 2:
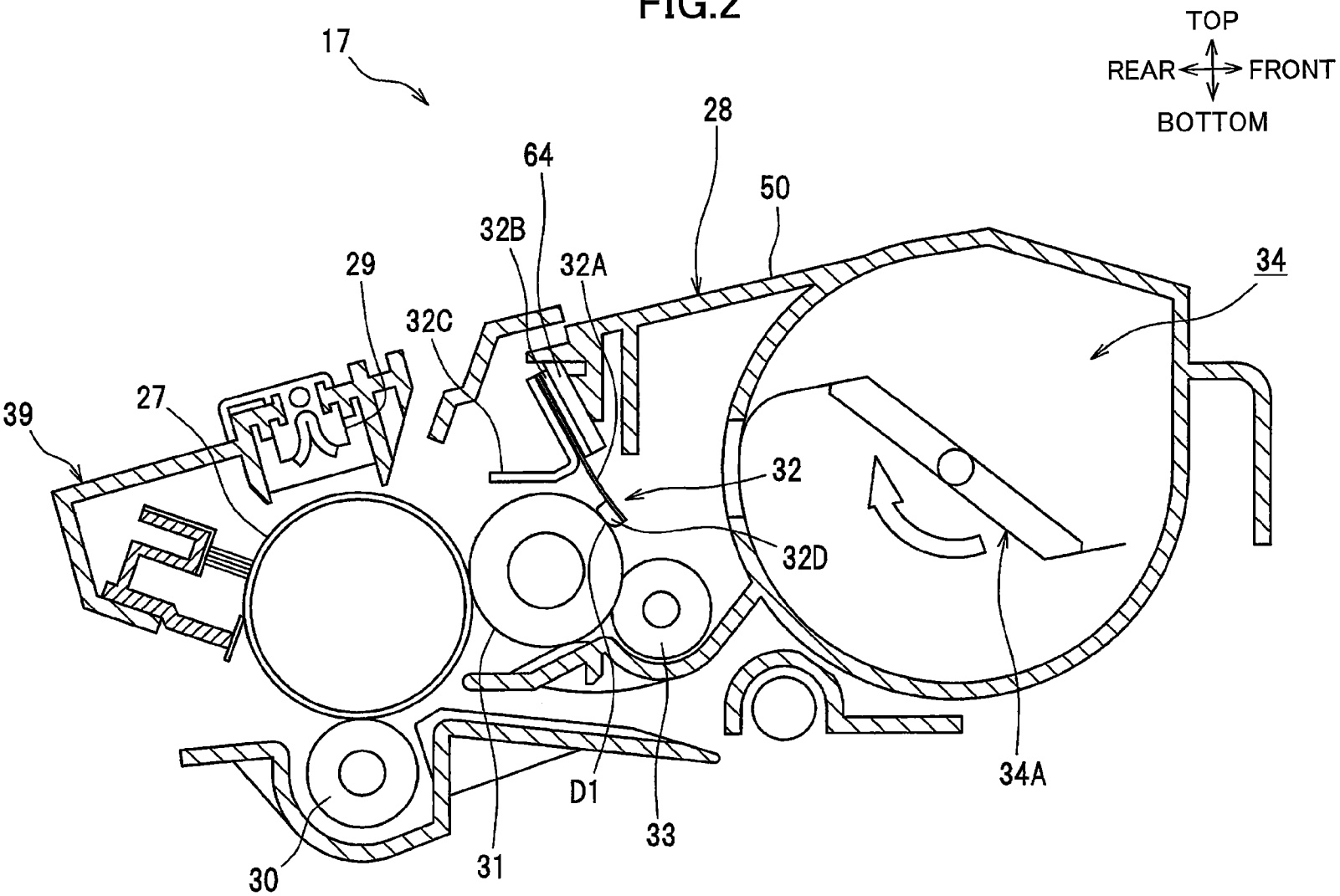
FIG. 2 is a cross-sectional view of the developing cartridge.

The developing cartridge 28 is detachably mounted in the main casing 2 in a state where the developing cartridge 28 is mounted in the drum unit 39. Incidentally, the drum unit 39 may be fixed to the main casing 2, and the developing cartridge 28 may be detachably mounted to the drum unit 39 fixed to the main casing 2. As illustrated in FIG. 2, the developing cartridge 28 includes a developing roller 31, a layer thickness regulating blade 32, a supply roller 33, and a toner chamber 34.

In the developing cartridge 28, toner (as an example of a developer) contained in the toner chamber 34 is agitated by an agitator 34A and is then supplied to the developing roller 31 by the supply roller 33. At this time, the toner is positively tribo-charged between the supply roller 33 and the developing roller 31. Thereafter, as the developing roller 31 rotates, the toner carried on the developing roller 31 enters between the layer thickness regulating blade 32 and the developing roller 31, and the layer thickness regulating blade 32 regulates the thickness of the toner carried on the developing roller 31 while the toner is further tribo-charged.

The drum unit 39 includes the photosensitive drum 27, a scorotron charger 29, and a transfer roller 30. In the drum unit 39, the surface of the photosensitive drum 27 is uniformly positively charged by the scorotron charger 29 and is thereafter exposed to the laser beam emitted from the scanner unit 16 in a high-speed scan. As a result, electric potential at the exposed portion decreases and thus an electrostatic latent image based on image data is formed on the surface of the photosensitive drum 27.

Subsequently, the toner carried on the developing roller 31 is supplied, by rotation of the developing roller 31, to the electrostatic latent image formed on the surface of the photosensitive drum 27, whereby a toner image is formed on the surface of the photosensitive drum 27. Thereafter, while the sheet 3 is fed between the photosensitive drum 27 and the transfer roller 30, the toner image carried on the surface of the photosensitive drum 27 is transferred onto the sheet 3.

As illustrated in FIG. 1, the fixing unit 18 includes a heating roller 41 and a pressure roller 42. The pressure roller 42 is disposed opposite to the heating roller 41 and applies pressure to the heating roller 41. In the fixing unit 18 with this configuration, the toner image transferred onto the sheet 3 is thermally fixed to the sheet 3 while the sheet 3 passes between the heating roller 41 and the pressure roller 42. The sheet 3 onto which the toner image has been thermally fixed is discharged to a discharge tray 46 by a discharge roller 45 disposed downstream of the fixing unit 18 in a sheet conveyance direction.

Detailed Structure of Developing Cartridge

Figure 3:
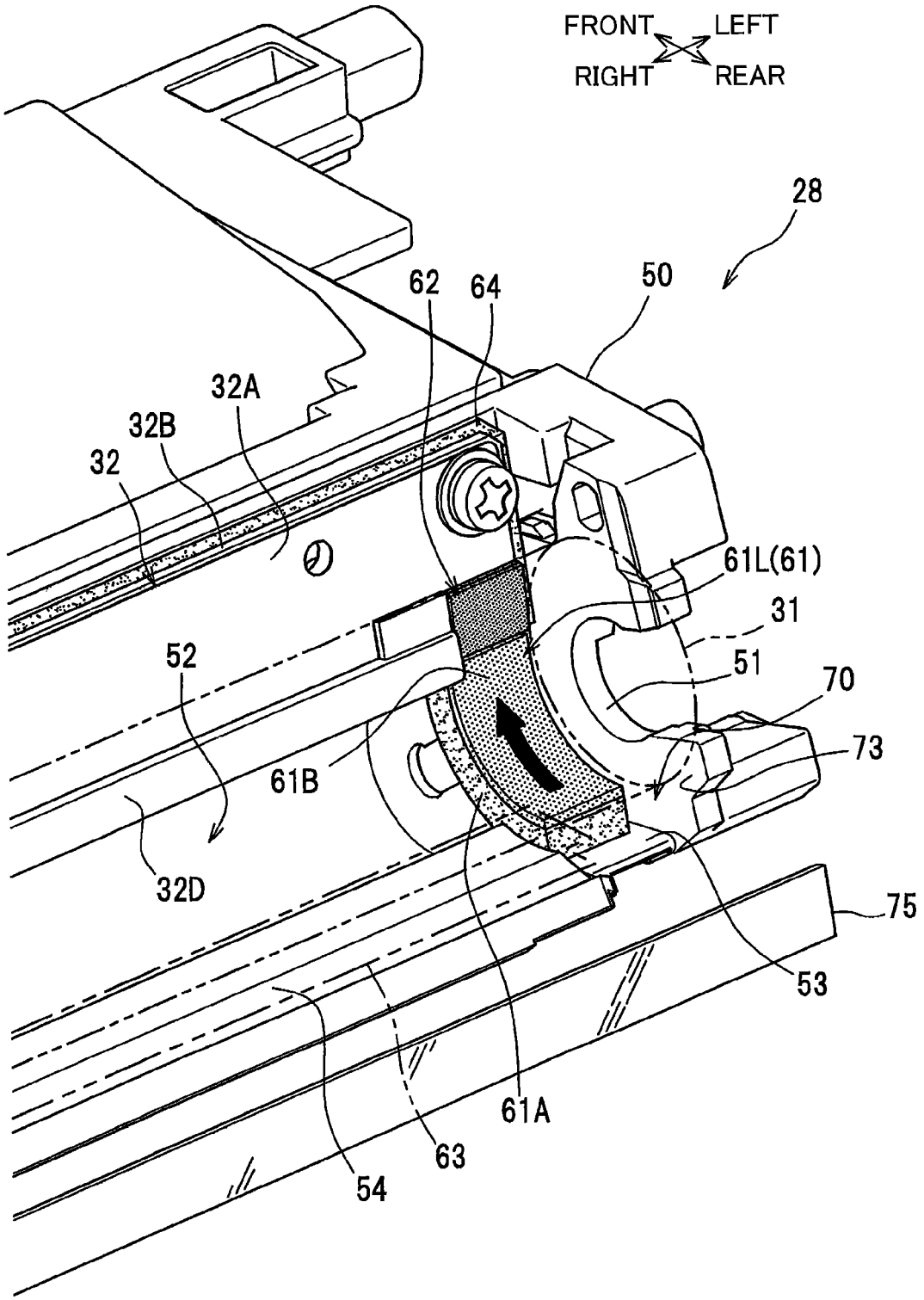
FIG. 3 is an enlarged partial perspective view of the developing cartridge, illustrating a structure around a supply port.

Next, a configuration of the developing cartridge 28 will be described in detail. Since the developing cartridge 28 has left-right symmetry, only a left portion of the developing cartridge 28 is illustrated in FIG. 3, whereas a right portion thereof is omitted. Further, FIG. 3 illustrates the developing cartridge 28 in a state where the developing roller 31, the supply roller 33 and a reinforcing plate 32B (described later) have been removed from a casing 50 (described later).

As illustrated in FIG. 3, the developing cartridge 28 further includes the casing 50, a pair of blade seals 62, a pair of side seals 61, and a lower film 63.

When the developing roller 31 mounted in the casing 50 rotates, an upper portion of the developing roller 31 is in sliding contact with the layer thickness regulating blade 32 and the pair of blade seals 62, left and right end portions of the developing roller 31 are in sliding contact with the pair of side seals 61, and a lower portion of the developing roller 31 is in sliding contact with the lower film 63.

The casing 50 accommodates toner therein. The casing 50 has a pair of outer walls 73, a supply port 52, a pair of side seal attachment surfaces 53, and a support portion 54.

The outer walls 73 each have a shaft support portion 51 for rotatably supporting the developing roller 31 through a shaft support member (not illustrated).

The supply port 52 is provided for supplying toner from the toner chamber 34 inside the casing 50 to the developing roller 31. The supply port 52 is formed in a rectangular shape that is elongated in an axial direction of the developing roller 31. The supply port 52 has an upper portion to which the layer thickness regulating blade 32 is fixed. The layer thickness regulating blade 32 protrudes downward from the upper portion of the supply port 52.

The side seal attachment surfaces 53 are provided one each on left and right sides of the supply port 52. The side seal 61 is attached to the side seal attachment surface 53. The side seal attachment surface 53 is substantially an arcuate surface in a side view.

The support portion 54 supports the lower film 63. The support portion 54 is disposed below the supply port 52. The support portion 54 extends in the axial direction of the developing roller 31, and protrudes to a developing roller 31 side further than the side seal attachment surfaces 53.

As illustrated in FIG. 2, the layer thickness regulating blade 32 includes a blade metal plate 32A, reinforcing plates 32B and 32C, and a pressing member 32D.

As illustrated in FIG. 3, the pressing member 32D regulates the thickness of toner supplied onto an outer peripheral surface of the developing roller 31 with the outer peripheral surface slidingly contacting the pressing member 32D. The pressing member 32D is made of a material such as rubber, more specifically, foamed rubber.

The pressing member 32D extends in a left-right direction (i.e. axial direction of the developing roller 31) and fixed to a lower end portion of the blade metal plate 32A. The pressing member 32D has a left-right length that is smaller than that of the blade metal plate 32A. The pressing member 32D has a lower edge linearly extending in the left-right direction.

Each blade seal 62 has a rectangular shape. The blade seals 62 are attached onto the blade metal plate 32A at positions adjacent to the pressing member 32D. More specifically, the blade seals 62 are provided one each on outer left and right sides of the pressing member 32D. Each blade seal 62 has a configuration similar to that of the side seal 61. Thus, description on the configuration of the blade seal 62 is omitted.

As illustrated in FIG. 2, the layer thickness regulating blade 32 with the above-described configuration is fixed to the casing 50 at an upper portion of the blade metal plate 32A interposed between the reinforcing plates 32B and 32C. The blade metal plate 32A applies a biasing force to the pressing member 32D and the blade seals 62 both disposed at the lower end portion of the blade metal plate 32A, while the developing roller 31 slidingly contacts the pressing member 32D and the blade seals 62.

A blade back seal 64 is provided at a position between the layer thickness regulating blade 32 and the casing 50. More specifically, the blade back seal 64 is formed in substantially an inverted U-shape surrounding the upper portion of the supply port 52. Left and right end portions of the blade back seal 64 are attached to upper portions of the left and right side seal attachment surfaces 53, respectively.

As illustrated in FIG. 3, each side seal 61 is provided for preventing toner from leaking through a gap between the casing 50 and the left-right end portion of the developing roller 31 (i.e. cylindrical portion 82, 83, described later). Each side seal 61 is provided between the left-right end portion of the developing roller 31 and the side seal attachment surface 53.

Figure 4A:
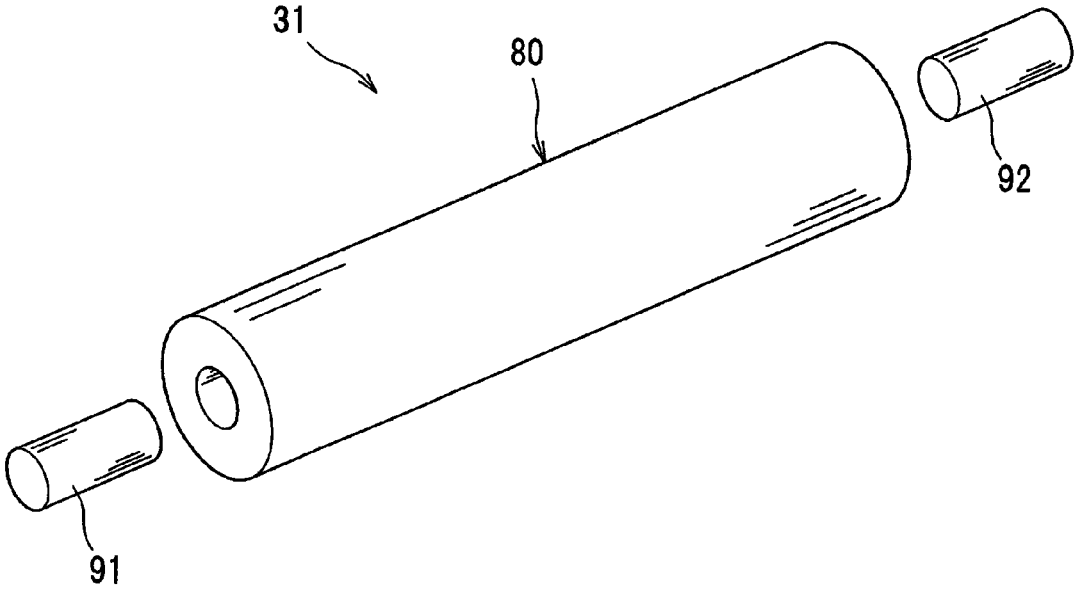
FIG. 4A is an exploded perspective view of a developing roller.
Figure 4B:
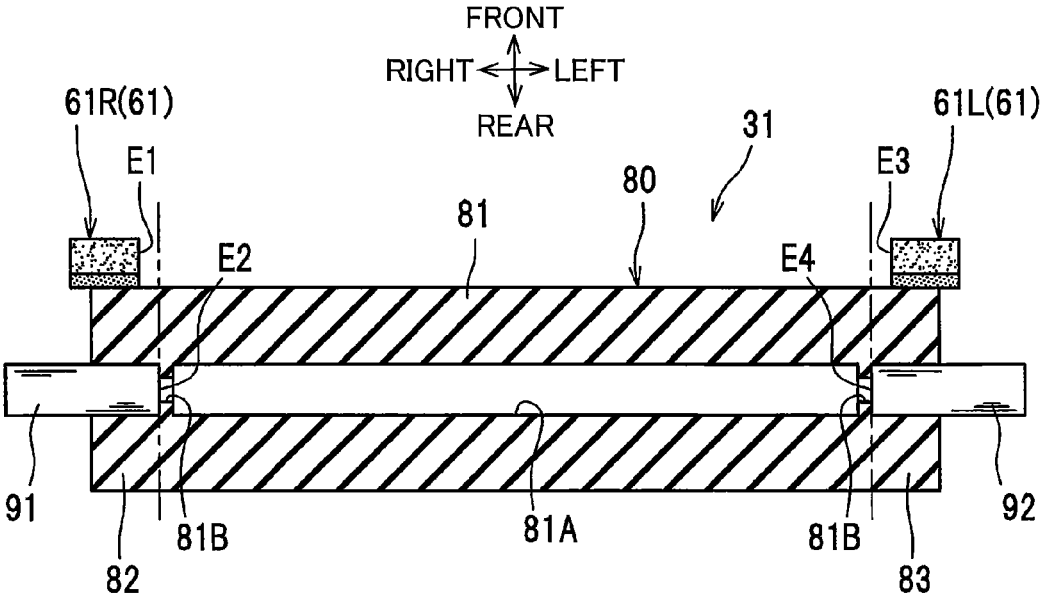
FIG. 4B is a cross-sectional view of the developing roller and a pair of side seals.

More specifically, each side seal 61 is disposed below and adjacent to the blade seal 62, and also disposed on an outer side of the support portion 54 in the left-right direction. In the embodiment, as illustrated in FIG. 4B, the side seal 61 disposed on a side where the right end portion of the developing roller 31 is located will be referred to as a first side seal 61R, and the side seal 61 disposed on a side where the left end portion of the developing roller 31 is located will be referred to as a second side seal 61L, when it is necessary to distinguish between the two.

The side seal 61 includes a base portion 61A having resiliency, and a layered portion 61B. The base portion 61A has a surface on the developing roller 31 side, and the layered portion 61B is layered on the surface of the base portion 61A. The base portion 61A is made of resiliently deformable material, such as urethane sponge, which is softer than a material of which the layered portion 61B is made. The base portion 61A is attached to the side seal attachment surface 53 by a double-stick tape or an adhesive, for example.

The layered portion 61B is made of a felt material thinner than the base portion 61A. The layered portion 61B is attached onto the base portion 61A by a double-stick tape, for example.

The lower film 63 is a sheet-like member that is made of resin, such as polyethylene terephthalate, and extends in the axial direction of the developing roller 31. The lower film 63 has a left-right length longer than that of the support portion 54. In a state where the lower film 63 is attached to the support portion 54, both left and right end portions of the lower film 63 protrude from the support portion 54. The portions of the lower film 63 protruding from the support portion 54 are superposed with the side seals 61, respectively.

The casing 50 is further provided with a pair of developer receiving portions 70 each disposed on a rear side of the side seal 61. The developer receiving portion 70 is formed in a concave shape having a top opening. More specifically, the developer receiving portion 70 is defined by the side seal attachment surface 53, the support portion 54, the outer wall 73 disposed on an outer left-right side of the side seal attachment surface 53, the side seal 61, and a flexible sheet-like member 75. The sheet-like member 75 is attached to a rear end portion of the casing 50 and extends along the rear end portion of the casing 50. If toner deposited on the blade seal 62 is captured by the developing roller 31 to be conveyed toward the side seal 61, the toner can be received by the developer receiving portion 70 even if the toner is scraped off from the developing roller 31 by the edge of the side seal 61. Hence, the developer receiving portion 70 can prevent the toner leaking from the developing cartridge 28.

Next, the developing roller 31 according to the embodiment of the present invention will be described in detail.

The developing roller 31 is configured to carry toner thereon. As illustrated in FIG. 4A, the developing roller 31 includes a roller body 80 made of rubber, a first rotation shaft 91 made of metal, and a second rotation shaft 92 made of metal.

As illustrated in FIG. 4B, the roller body 80 includes a sleeve body portion 81, a first cylindrical portion 82 provided at one end portion (i.e. right end portion) of the body portion 81, and a second cylindrical portion 83 provided at another end portion (i.e. left end portion) thereof. The body portion 81 is a portion of the roller body 80 positioned inward of two dashed double-dotted lines indicated in FIG. 4B in the left-right direction.

The first rotation shaft 91 and the second rotation shaft 92 are cylindrical in shape and have outer diameters substantially equal to inner diameters of the first cylindrical portion 82 and the second cylindrical portion 83. The first rotation shaft 91 and the second rotation shaft 92 have an axial length smaller than that of the roller body 80. The first rotation shaft 91 is fitted with the first cylindrical portion 82, and the second rotation shaft 92 is fitted with the second cylindrical portion 83.

That is, the first rotation shaft 91 and the second rotation shaft 92 are spaced away from each other in the axial direction, and the cylindrical portion of the roller body 80 fitted with the first rotation shaft 91 is the first cylindrical portion 82, and the cylindrical portion of the roller body 80 fitted with the second rotation shaft 92 is the second cylindrical portion 83, and the sleeve portion of the roller body 80 not fitted with the first rotation shaft 91 or the second rotation shaft 92 is the body portion 81.

With this structure, the body portion 81 having a hollow configuration is more deformable than the first cylindrical portion 82 and the second cylindrical portion 83 with which the first rotation shaft 91 and the second rotation shaft 92 are fitted respectively. Therefore, excessive application of force or stress to the toner located at a nip portion between the developing roller 31 and the supply roller 33 can be restrained. Further, an intimate contact between the developing roller 31 and the photosensitive drum 27 with a proper nip pressure can be provided because of easily deformable nature of the body portion 81. Thus, an appropriate amount of toner can be provided to the electrostatic latent image at an axially center portion of the photosensitive drum 27. This can reduce the problem of weak concentration of the toner image at a widthwise center portion of the sheet 3 due to insufficient toner supply to the axially center portion of the photosensitive drum 27.

Incidentally, the supply roller 33 has an axial length (i.e. length of a roller body excluding a length of a rotation shaft protruding from the roller body) smaller than that of the body portion 81. Further, each axial end of the supply roller 33 is preferably positioned inward of each axial end of the body portion 81. With this arrangement, excessive application of stress to the toner located on an entire outer peripheral surface of the supply roller 33 can be restrained.

Further, the body portion 81 has an inner peripheral surface 81A which has axial end portions each provided with an annular protrusion 81B (as an example of a first engagement portion). Each annular protrusion 81B has a radially inward protruding length from the inner peripheral surface 81A such that each axially inner end face E2, E4 of each rotation shaft 91, 92 is in abutment with the annular protrusion 81B. In other words, each annular protrusion 81B has an inner diameter smaller than that of each cylindrical portion 82, 83. That is, the inner diameter of each annular protrusion 81B is smaller than the outer diameter of each rotation shaft 91, 92.

With this structure, the first rotation shaft 91 is easily subjected to positioning relative to the roller body 80 upon abutment with the corresponding annular protrusion 81B when the first rotation shaft 91 is fitted with the first cylindrical portion 82. Similarly, the second rotation shaft 92 is easily subjected to positioning relative to the roller body 80 upon abutment with the corresponding annular protrusion 81B when the second rotation shaft 92 is fitted with the second cylindrical portion 83.

Further, the first side seal 61R has an inner end E1 (as an example of a first inner end) in the left-right direction (i.e. axial direction) that is positioned outward of the axially inner end face E2 (as an example of a first inner end face) of the first rotation shaft 91 in the left-right direction. The second side seal 61L has an inner end E3 (as an example of a second inner end) in the left-right direction that is positioned outward of the axially inner end face E4 (as an example of a second inner end face) of the second rotation shaft 92 in the left-right direction.

Alternatively, the inner end E1 and the inner end face E2 may be aligned with each other in the left-right direction, and the inner end E3 and the inner end face E4 may be aligned with each other in the left-right direction.

With this arrangement, the first side seal 61R can press the axial end portion of the roller body 80 supported by the first rotation shaft 91 at high pressure, because the axial end portion is reinforced by the first rotation shaft 91. In other words, the first side seal 61R disposed between the first cylindrical portion 82 and the casing 50 can press the first cylindrical portion 82 at high pressure. Hence, sealability between the roller body 80 and the first side seal 61R can be enhanced. Similarly, the second side seal 61L can press the axial end portion of the roller body 80 supported by the second rotation shaft 92 at high pressure, because the axial end portion is reinforced by the second rotation shaft 92. In other words, the second side seal 61L disposed between the second cylindrical portion 83 and the casing 50 can press the second cylindrical portion 83 at high pressure. Hence, sealability between the roller body 80 and the second side seal 61L can also be enhanced.

Modifications

Various modifications are conceivable. In the following description, only parts differing from those of the embodiment will be described in detail.

First Modification

Figure 5:
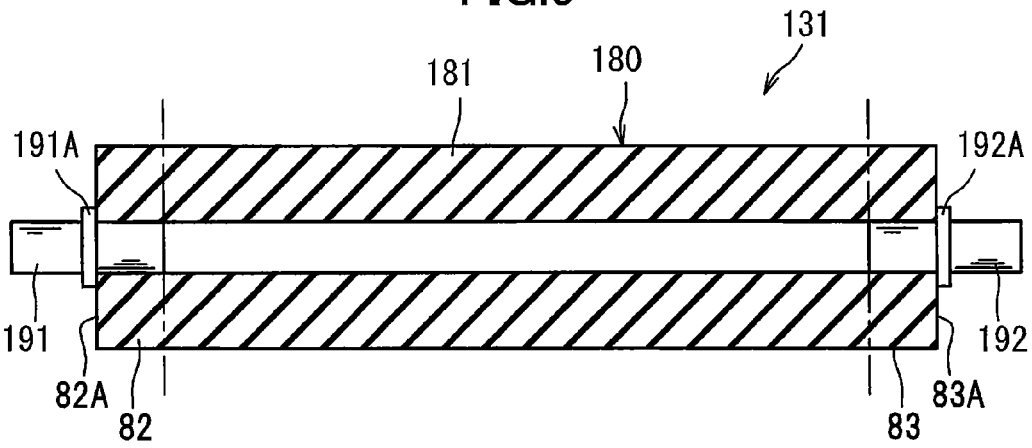
FIG. 5 is a cross-sectional view of a developing roller according to a first modification of the present invention.

In the above-described embodiment, the annular protrusions 81B as the positioning portions (engagement portions) for fixing the axial position of the rotation shafts 91, 92 are provided at the body portion 81. However, in a developing roller 131 according to a first modification, such positioning or engagement portions are not necessarily provided in a body portion 181 of a roller body 180. As illustrated in FIG. 5, each rotation shaft 191, 192 can be provided with such positioning or engagement portions. More specifically, the first rotation shaft 191 has an outer peripheral surface from which an annular protrusion 191A (as an example of a second engagement portion) protrudes radially outwardly, and the second rotation shaft 192 has an outer peripheral surface from which an annular protrusion 192A (as an example of a third engagement portion) protrudes radially outwardly. The annular protrusion 191A is in abutment with an axially outer end face 82A (as an example of a first outer end face) of the first cylindrical portion 82 of the roller body 180. The annular protrusion 192A is in abutment with an axially outer end face 83A (as an example of a second outer end face) of the second cylindrical portion 83 of the roller body 180.

With this structure, because of abutment of the annular protrusions 191A, 192A with the end faces 82A, 83A, the first and second rotation shafts 191, 192 are subjected to positioning in their axial direction.

Second Modification

Figure 6:
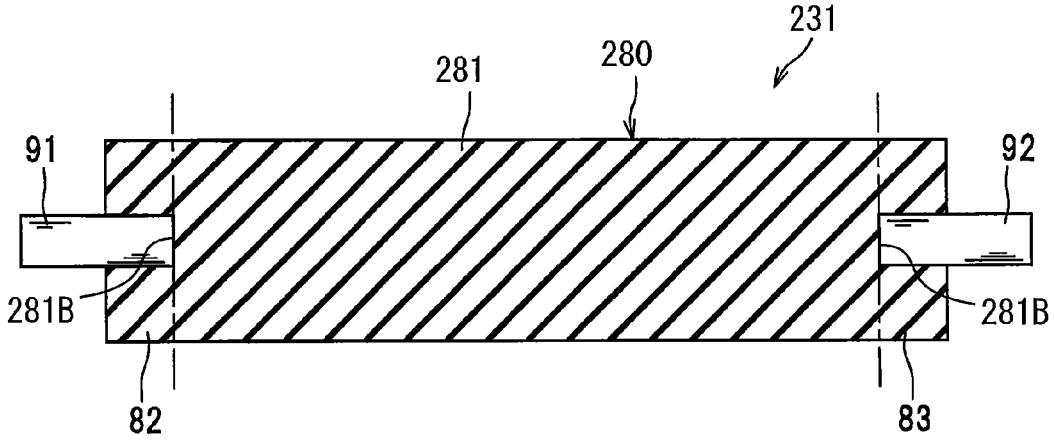
FIG. 6 is a cross-sectional view of a developing roller according to a second modification of the present invention.

In the above-described embodiment, the body portion 81 is hollow cylindrical in shape. However, in a developing roller 231 according to a second modification, as illustrated in FIG. 6, a roller body 280 includes a solid cylindrical body portion 281. Even in this case, the cylindrical body portion 281 is more deformable than the first and second cylindrical portions 82, 83 because of non-extension of the first and second rotation shafts 91, 92 through the cylindrical body portion 281. Therefore, this structure can provide the function the same as that obtained in the above-described embodiment. Further, each axially outer end face 281B of the cylindrical body portion 281 can function as a stop portion (first engagement portion) for preventing the first and second rotation shafts 91, 92 from their axially inward movements, facilitating positioning of the first and second rotation shafts 91, 92 in their axial direction.

Third Modification

Figure 7:
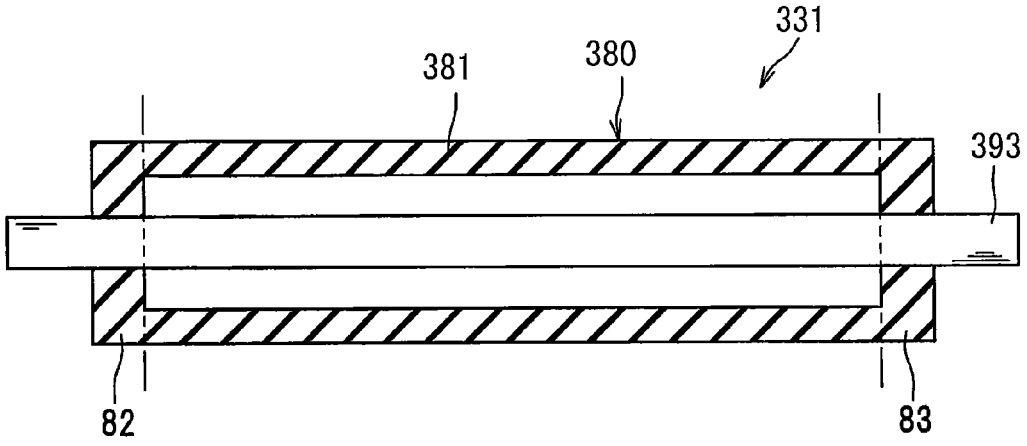
FIG. 7 is a cross-sectional view of a developing roller according to a third modification of the present invention.

In a developing roller 331 according to a third modification, as illustrated in FIG. 7, a roller body 380 includes a body portion 381 with a wall thickness smaller than that of the first and second cylindrical portions 82, 83. More specifically, the body portion 381 has an outer diameter equal to that of the first and second cylindrical portions 82, 83, whereas the body portion 381 has an inner diameter greater than that of the first and second cylindrical portions 82, 83. With this structure, the body portion 381 is more deformable than the first and second cylindrical portions 82, 83, so that this structure can provide the function the same as that obtained in the above-described embodiment.

In this case, a single rotation shaft 393 is sufficient instead of the two rotation shafts 91, 92 (191, 192). In other words, the two rotation shafts can be formed integrally with each other as long as the body portion 381 is more deformable than the first and second cylindrical portions 82, 83.

Other Modifications

In the above-described embodiment, the annular protrusion 81B is provided as the first engagement portion. However, the first engagement portion can be a single pillared protrusion or a plurality of pillared protrusions instead of the annular protrusion. Similarly, the second and third engagement portions can be a single pillared protrusion or a plurality of pillared protrusions, instead of the annular protrusion.

Further, in the above-described embodiment, the inner peripheral surfaces of the first and second cylindrical portions 82, 83 and the outer peripheral surfaces of the first and second rotation shafts 91, 92 in fitting engagement with the inner peripheral surfaces are cylindrical in shape. However, the outer and inner peripheral surfaces can be polygonal in shape, which can avoid slippage of the first and second rotation shafts with respect to the first and second cylindrical portions. Further, in order to prevent the slippage between the first and second rotation shafts and the first and second cylindrical portions, respectively, a projection can be formed at one of the inner peripheral surface of the cylindrical portion and the outer peripheral surface of the rotation shaft, and a recess in engagement with the projection can be formed at remaining one of the inner peripheral surface of the cylindrical portion and the outer peripheral surface of the rotation shaft.

Further, the above-described developing roller and the above-described developing device are applied to the laser printer 1. However, these can be applied to an image forming device such as a copying machine and a multifunction apparatus other than the laser printer.

Further, in the above-described developing device, the developing cartridge 28 integrally includes the toner chamber 34. However, another developing cartridge is available in which a toner cartridge having a toner chamber is attachable to and detachable from a developing cartridge.

Further, in the above-described embodiment, the side seal and the blade seal provide a bilayer structure. However, a single layer or not less than three multiple layers are also available as such seals.

While the present invention has been described in detail with reference to the embodiment thereof, it would be apparent to those skilled in the art that various changes and modifications may be made therein without departing from the spirit of the present invention.

What is claimed is:

1. A developing roller configured to carry developer and extending in an axial direction, the developing roller comprising:

a first rotation shaft having a first inner end face in the axial direction;

a second rotation shaft having a second inner end face in the axial direction;

a rubber body portion having a first side and a second side opposite to the first side in the axial direction, the rubber body portion having a first outer diameter, the rubber body portion including a pair of first engagement portions, one of the pair of first engagement portions having a first surface facing in the axial direction and being configured to be engaged with the first inner end face such that the first surface contacts the first inner end face, and a remaining one of the pair of first engagement portions having a second surface facing in the axial direction and being configured to be engaged with the second inner end face such that the second surface contacts the second inner end face;

a first cylindrical rubber portion disposed on the first side, the first rotation shaft being configured to be fitted with the first cylindrical rubber portion, the first cylindrical rubber portion having a second outer diameter; and a second cylindrical rubber portion disposed on the second side, the second rotation shaft being configured to be fitted with the second cylindrical rubber portion, the second cylindrical rubber portion having a third outer diameter, the first outer diameter being equal to the second outer diameter and equal to the third outer diameter, the rubber body portion being configured to be deformable more than the first cylindrical rubber portion and the second cylindrical rubber portion, wherein the one of the pair of first engagement portions is configured to prevent the first rotation shaft from moving toward the rubber body portion in the axial direction such that the first rotation shaft is fixed in position relative to the first cylindrical rubber portion, and the remaining one of the pair of first engagement portions is configured to prevent the second rotation shaft from moving toward the rubber body portion in the axial direction such that the second rotation shaft is fixed in position relative to the second cylindrical rubber portion.

2. The developing roller as claimed in claim 1, wherein the rubber body portion has a hollow cylindrical configuration.

3. The developing roller as claimed in claim 1, wherein the rubber body portion has a solid cylindrical configuration.

4. The developing roller as claimed in claim 1, wherein the pair of first engagement portions each extends along a flat plane orthogonal to the axial direction.

5. A developing device comprising a developing roller configured to carry developer and extending in an axial direction, the developing roller comprising:

a first rotation shaft having a first inner end face in the axial direction;

a second rotation shaft having a second inner end face in the axial direction;

a rubber body portion having a first side and a second side opposite to the first side in the axial direction, the rubber body portion having a first outer diameter, the rubber body portion including a pair of first engagement portions, one of the pair of first engagement portions having a first surface facing in the axial direction and being configured to be engaged with the first inner end face such that the first surface contacts the first inner end face, and a remaining one of the pair of first engagement portions having a second surface facing in the axial direction and being configured to be engaged with the second inner end face such that the second surface contacts the second inner end face;

a first cylindrical rubber portion disposed on the first side, the first rotation shaft being configured to be fitted with the first cylindrical rubber portion, the first cylindrical rubber portion having a second outer diameter; and a second cylindrical rubber portion disposed on the second side, the second rotation shaft being configured to be fitted with the second cylindrical rubber portion, the second cylindrical rubber portion having a third outer diameter, the first outer diameter being equal to the second outer diameter and equal to the third outer diameter, the rubber body portion being configured to be deformable more than the first cylindrical rubber portion and the second cylindrical rubber portion, wherein the one of the pair of first engagement portions is configured to prevent the first rotation shaft from moving toward the rubber body portion in the axial direction such that the first rotation shaft is fixed in position relative to the first cylindrical rubber portion, and the remaining one of the pair of first engagement portions is configured to prevent the second rotation shaft from moving toward the rubber body portion in the axial direction such that the second rotation shaft is fixed in position relative to the second cylindrical rubber portion.

6. The developing device as claimed in claim 5, wherein the developing device further comprising:

a casing configured to accommodate the developer therein;

a first side seal disposed between the first cylindrical rubber portion and the casing for preventing the developer from leaking from a gap between the first cylindrical rubber portion and the casing, the first side seal has a first inner end in the axial direction; and a second side seal disposed between the second cylindrical rubber portion and the casing for preventing the developer from leaking from a gap between the second cylindrical rubber portion and the casing, the second side seal has a second inner end in the axial direction;

wherein the first rotation shaft has a first inner end face in the axial direction, and the second rotation shaft has a second inner end face in the axial direction, and wherein the first inner end of the first side seal is positioned outward of the first inner end face of the first rotation shaft in the axial direction, and the second inner end of the second side seal is positioned outward of the second inner end face of the second rotation shaft in the axial direction.

7. The developing device as claimed in claim 5, wherein the developing device further comprising:

a casing configured to accommodate the developer therein;

a first side seal disposed between the first cylindrical rubber portion and the casing for preventing the developer from leaking from a gap between the first cylindrical rubber portion and the casing, the first side seal has a first inner end in the axial direction; and a second side seal disposed between the second cylindrical rubber portion and the casing for preventing the developer from leaking from a gap between the second cylindrical rubber portion and the casing, the second side seal has a second inner end in the axial direction;

wherein the first rotation shaft has a first inner end face in the axial direction, and the second rotation shaft has a second inner end face in the axial direction, and wherein the first inner end of the first side seal is aligned with the first inner end face of the first rotation shaft in the axial direction, and the second inner end of the second side seal is aligned with the second inner end face of the second rotation shaft in the axial direction.

8. The developing device as claimed in claim 5, wherein the rubber body portion has a hollow cylindrical configuration.

9. The developing device as claimed in claim 5, wherein the rubber body portion has a solid cylindrical configuration.

10. The developing roller as claimed in claim 5, wherein the pair of first engagement portions each extends along a flat plane orthogonal to the axial direction.

* * * * *